United States Patent [19]

Leibinger

[11] Patent Number: 4,524,661

[45] Date of Patent: Jun. 25, 1985

[54] BOTTOM DIE CONSTRUCTION

[75] Inventor: Berthold Leibinger, Gerlingen, Fed. Rep. of Germany

[73] Assignee: Trumpf GmbH & Co., Fed. Rep. of Germany

[21] Appl. No.: 414,590

[22] Filed: Sep. 3, 1982

[30] Foreign Application Priority Data

Sep. 15, 1981 [DE] Fed. Rep. of Germany ..... 3136514

[51] Int. Cl.[3] ..... B26F 1/14; B26D 1/00

[52] U.S. Cl. ..... 83/690; 83/684; 83/694

[58] Field of Search ..... 83/679, 684, 685, 690, 83/698, 196, 197, 198, 199, 200, 694; 76/107 R

[56] References Cited

U.S. PATENT DOCUMENTS

| | | | |
|---|---|---|---|
| 86,162 | 1/1869 | Jeffers | 83/690 |
| 109,249 | 11/1870 | Rice | 83/690 |
| 2,533,922 | 12/1950 | Deichmiller et al. | 83/690 |
| 2,638,985 | 5/1953 | Ross | 83/199 X |
| 4,023,788 | 5/1977 | Herb et al. | 269/73 |
| 4,085,639 | 4/1978 | Marconi | 83/690 X |
| 4,220,062 | 9/1980 | Blanz | 83/71 |
| 4,250,786 | 2/1981 | Bleich | 83/684 X |

*Primary Examiner*—Paul A. Bell
*Assistant Examiner*—Taylor J. Ross
*Attorney, Agent, or Firm*—McGlew and Tuttle

[57] ABSTRACT

A bottom die provided with a cutting edge which is closed within itself used with stamping machines having a seat for the bottom die comprises a die body made up of at least two separate body parts adapted to be assembled together and forming an annular exterior die part with an internal die cutting edge. The body parts are separable along a parting line which is transverse to the die cutting edge. The body parts are held together by suitable means such as clamping screws.

1 Claim, 3 Drawing Figures

BOTTOM DIE CONSTRUCTION

FIELD AND BACKGROUND OF THE INVENTION

The invention relates in general to stamping machines and in particular to a new and useful bottom or female die provided with a cutting edge closed in itself, for stamping machines having a seat for a bottom die.

Such dies are usually manufactured on wire erosion machines, with the core being erroded by means of a wire. This is a complicated and thus relatively expensive operation having in addition the disadvantage that the inside surfaces of the die worked in this way are relatively rough. Other methods of making holes are also difficult, primarily if an angular or arcuate inside surface is provided. Since they are made of a brittle material, bottom dies have still another disadvantage, namely that they break at their corners upon overload.

SUMMARY OF THE INVENTION

The present invention is directed to a bottom die which is relatively simple to manufacture and inexpensive, and with which the risk of breaking is minimized.

This is obtained in accordance with the invention by providing a die comprising at least two parts, with the parting line extending transversely to the cutting edge, and including assembling means for the parts. Such a die can be manufactured simply by grinding the individual parts, which results in the further advantage that the obtained surfaces are very satisfactory. Any overloads are to a large extend absorbed by the assembling means, so that breakage is substantially eliminated.

The assembling means may be embodied by a screw connection or, in accordance with another feature of the invention, as a fixture closed in itself.

Accordingly, it is an object of the invention to provide a bottom die which is provided with a cutting edge which is closed in itself for use with stamping machines which have a seat for the bottom die and wherein the bottom die body comprises at least two separate body parts adapted to be assembled together and form an annular exterior die part with an internal die cutting edge, the body parts being separable along a parting line or lines which are transverse to the die cutting edge and wherein the body parts are held together by suitable holding elements.

A further object of the invention is to provide a bottom die which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
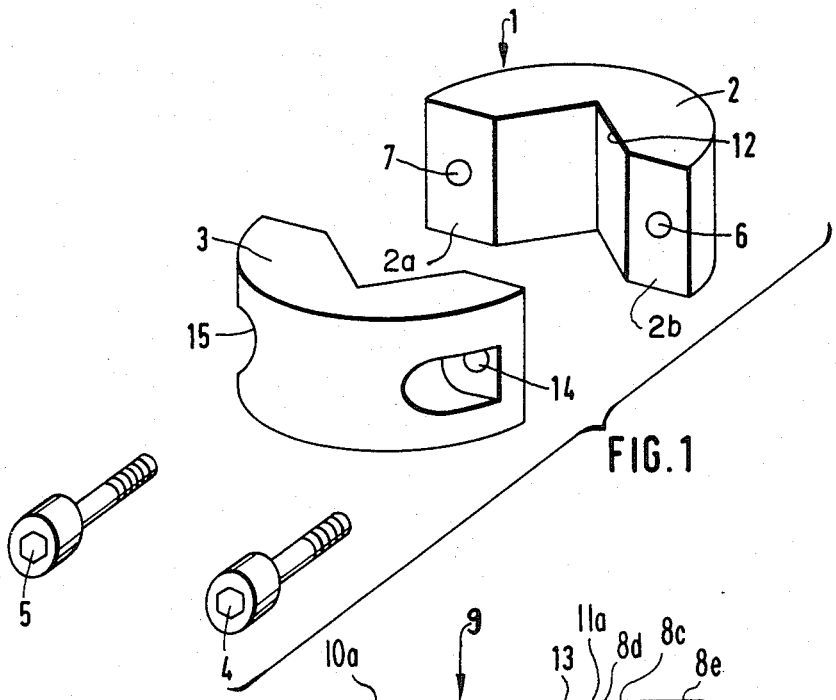
FIG. 1 is an exploded perspective view of a two part die constructed in accordance with the invention.

Referring to the drawings in particular the invention embodied therein comprises a body die generally designated 1 as shown in FIG. 1 which comprises a bottom die body comprising at least two separate body parts 2 and 3 adapted to be assembled together and forming an annular exterior die part with an internal die cutting edge 12. The body parts are separable along parting lines which, for example extend along the parting faces 2*a* and 2*b* in corresponding surfaces of the other part 3. The parting lines are transverse to the die cutting edge 12. Means are provided for holding the parts together and in the embodiment of FIG. 1 these comprise screw members or bolts 4 and 5 which extend through openings 14 and 15 in the part 3 and engage in threaded openings 6 and 7 of the part 2.

Figure 2:
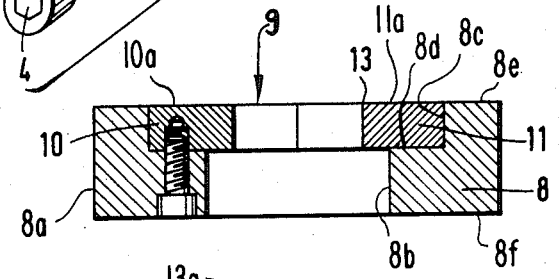
FIG. 2 is a transverse sectional view of a die of another embodiment of the invention.

The die 1, in accordance with FIG. 1 comprises two parts 2 and 3, which are manufactured separately, for example, by grinding. The parting line defined along surfaces 2*a* and 2*b* extends transversely to cutting edge 12. The two parts are connected to each other by screws 4, 5 which are passed through holes 14, 15 provided in part 3 and screwed into tapholes 6,7 of part 2. In this way, upon manufacturing the individual parts, the shown assembly is produced so that the die can be inserted into a seat (not shown), of a stamping machine without problems. The die 9 according to FIG. 2 also comprises two parts 10,11 which are held assembled in a closed fixture 8. The parting line again extends transversely to cutting edge 13.

The fixture has an annular outer surface 8*a* which is of a size so that it can fit stamping machines that accept prior art one piece dies. There is also an inner surface 8*b* which defines a through opening that is larger than the cutting opening defined by the cutting edge 13. Fixture 8 has an annular recess defined by an annular intermediate surface 8*c* and an open shoulder surface 8*d*, for receiving the die 9. A screw holding each die half 10,11 (one screw is shown) extends parallel to the parting line 13*a*. A top surface 10*a*, 11*a* of the combined die is coplanar with a top surface 8*e* of the fixture 8 and shoulder surface 8*d* is above fixture bottom 8*f*.

Figure 3:
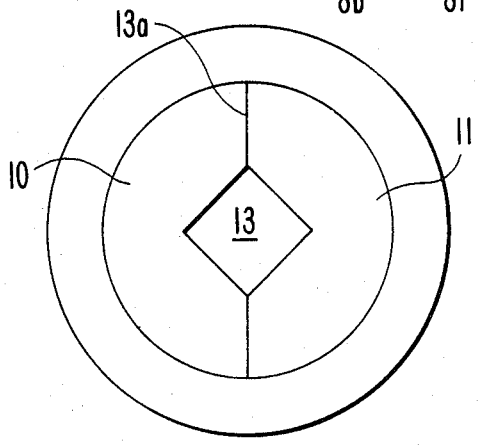
FIG. 3 is a top plan view of the die shown in FIG. 2.

As shown in FIG. 3, the outer surface 8*a* is circular. The intermediate surface 8*c* is also circular and in the embodiment shown is cylindrical. Similarly the exterior surface 8*a* of the fixture 8, in the embodiment shown, is cylindrical.

While specific embodiments of the invention have been shown and described in detail to illustrate the application of the principles of the invention, it will be understood that the invention may be embodied otherwise without departing from such principles.

What is claimed is:

1. A bottom die with a closed cutting edge for a stamping machine having a seat for a bottom die, comprising:

a bottom die body comprising two separate body parts (10,11) adapted to be assembled together and together forming a cylindrical exterior surface with an internal die cutting edge (13) defining a die cutting opening, said body parts being separable along a parting line (13*a*) which extends transversely across said die cutting opening;

a fixture (8) into which said body parts (10,11) are assembled, said fixture having a cylindrical outer surface (8*a*) of a size to be received in the seat of the stamping machine, a top surface (8*e*) and a bottom surface (8*f*), said fixture also having a through opening (8*b*) of a size larger than said die cutting opening (13) and a recess defined between a cylindrical intermediate surface (8*c*) of said fixture facing said through opening and a shoulder surface (8*d*) disposed above said bottom surface (8*f*) and bounding said through opening, said cylindrical exterior surface of said die body being substantially equal in diameter to said cylindrical intermediate surface (8*c*), said die body (10,11) being disposed in said recess; and a fastening screw connected between said fixture and each die body part to hold said die body in said recess, each fastening screw extending in a direction parallel to said parting line (13*a*);

said fixture having said opening (8*b*) thereof extending from said bottom surface (8*f*) thereof to said shoulder surface (8*d*) thereof through which each screw extends, each screw being threaded into each die body part respectively, said die body having a top surface (10*a*, 11*a*) and a bottom surface, said top surface of said die body being coplanar with said top surface of said fixture and said bottom surface of said die body being engaged on said shoulder surface of said fixture.

* * * * *